US012492091B2

(12) United States Patent
De Gaillande et al.

(10) Patent No.: US 12,492,091 B2
(45) Date of Patent: Dec. 9, 2025

(54) POSITIONING ASSEMBLY AND SHEET MATERIAL PROCESSING MACHINE

(71) Applicant: BOBST MEX SA, Mex (CH)

(72) Inventors: Christophe De Gaillande, Les Monts-de-Corsier (CH); Marco Cardillo, Lausanne (CH)

(73) Assignee: BOBST MEX SA, Mex (CH)

( * ) Notice: Subject to any disclaimer, the term of this patent is extended or adjusted under 35 U.S.C. 154(b) by 215 days.

(21) Appl. No.: 18/548,694

(22) PCT Filed: Feb. 28, 2022

(86) PCT No.: PCT/EP2022/054985
§ 371 (c)(1),
(2) Date: Sep. 1, 2023

(87) PCT Pub. No.: WO2022/189185
PCT Pub. Date: Sep. 15, 2022

(65) Prior Publication Data

US 2024/0166459 A1 May 23, 2024

(30) Foreign Application Priority Data

Mar. 8, 2021 (EP) ..... 21161184

(51) Int. Cl.
*B65H 9/12* (2006.01)
*B65H 7/08* (2006.01)
*B65H 7/10* (2006.01)

(52) U.S. Cl.
CPC ..... *B65H 9/12* (2013.01); *B65H 7/08* (2013.01); *B65H 7/10* (2013.01);
(Continued)

(58) Field of Classification Search
CPC ... B65H 9/12; B65H 9/10; B65H 7/08; B65H 7/10; B65H 5/14
See application file for complete search history.

(56) References Cited

U.S. PATENT DOCUMENTS 5,333,547 A 8/1994 Pfisterer et al.
6,378,862 B1 * 4/2002 Rebeaud ..... B65H 5/10 271/239

(Continued)

FOREIGN PATENT DOCUMENTS

AU 2017271083 A1 * 11/2018 ..... B65H 9/10
CN 203450846 U 2/2014

(Continued)

*Primary Examiner* — Patrick Cicchino
(74) *Attorney, Agent, or Firm* — Bookoff McAndrews, PLLC

(57) ABSTRACT

A positioning assembly (30) for positioning a sheet material, especially at an entry portion of a sheet material processing machine, is described. It comprises a support beam (32) on which at least a portion of a sheet material to be positioned can be placed and a plurality of clamping fingers (38). The support beam (32) is coupled to a drive unit (60) configured for translationally moving the support beam (32) along a travelling direction (y) of the sheet material, translationally moving the support beam (32) along a direction (x) transverse to the travelling direction (y) and rotationally moving the support beam (32) with respect to a pivot axis (z) being perpendicular to the traveling direction (y) and the transverse direction (x). Each of the clamping fingers (38) is coupled to an individual clamping finger actuation unit (40). Moreover, a sheet material processing machine comprising such a positioning assembly (30) is presented.

14 Claims, 3 Drawing Sheets

(52) U.S. Cl.
CPC ..... *B65H 2301/331* (2013.01); *B65H 2301/44331* (2013.01); *B65H 2405/581* (2013.01); *B65H 2405/584* (2013.01); *B65H 2511/516* (2013.01); *B65H 2701/1311* (2013.01); *B65H 2801/42* (2013.01)

(56) References Cited

U.S. PATENT DOCUMENTS

| | | | | |
|---|---|---|---|---|
| 8,960,410 | B2 * | 2/2015 | Rebeaud | B65H 7/14 198/464.4 |
| 10,005,631 | B2 * | 6/2018 | Collomb | B65H 9/106 |
| 11,498,789 | B2 * | 11/2022 | Reinsch | B65H 9/04 |
| 2001/0040334 | A1 | 11/2001 | Bettinelli | |

FOREIGN PATENT DOCUMENTS

| | | | | |
|---|---|---|---|---|
| CN | 209124763 | U | 7/2019 | |
| CN | 210558201 | U | 5/2020 | |
| EP | 1148009 | A1 * | 10/2001 | B65H 5/14 |
| GB | 2263105 | A | 7/1993 | |
| JP | H05254094 | A | 10/1993 | |
| JP | 2000327179 | A | 11/2000 | |
| TW | M306023 | U | 2/2007 | |

* cited by examiner

POSITIONING ASSEMBLY AND SHEET MATERIAL PROCESSING MACHINE

CROSS-REFERENCE TO RELATED APPLICATION(S)

This application is a National Stage Application under 35 U.S.C. § 371 of International Application No. PCT/EP2022/054985, filed on Feb. 28, 2022, which claims priority to European Application No. 21161184.3, filed on Mar. 8, 2021, the entireties of which are incorporated herein by reference.

The invention relates to a positioning assembly for positioning a sheet material, especially at an entry portion of a sheet material processing machine. The positioning assembly comprises a support beam on which at least a portion of a sheet material to be positioned can be placed and a plurality of clamping fingers, wherein each of the clamping fingers is configured for selectively taking a clamping position in which the respective clamping finger clamps the sheet material by pressing it onto the support beam and a release position in which the respective clamping finger releases the sheet material by being withdrawn from the support beam. The support beam is coupled to a drive unit configured for translationally moving the support beam along a travelling direction of the sheet material, translationally moving the support beam along a direction transverse to the travelling direction, and rotationally moving the support beam with respect to a pivot axis being perpendicular to the traveling direction and the transverse direction.

The invention is additionally directed to a sheet material processing machine, especially a sheet-to-sheet processing machine or die cutting machine, comprising such a positioning assembly. The positioning assembly is in particular mounted at an entry portion of the sheet material processing machine.

The sheet material is for example made from a paper material, a cardboard material or a plastics material.

Such positioning assemblies and sheet material processing machines equipped therewith are known, for example in U.S. Pat. No. 6,378,862 B1. The positioning assembly is used for positioning or aligning a sheet material when entering the sheet material processing machine. This is done by clamping the sheet material on the support beam and moving the latter translatorily along the travelling direction, often designated a y direction, moving it translatorily along a direction transverse to the travelling direction, often designated a x direction, and rotationally moving the support beam with respect to a pivot axis being perpendicular to the travelling direction and the transverse direction. This pivot axis is usually vertical and thus the rotation is often designated a rotation around a z direction. In doing so, the sheet material is moved into a desired position before it is gripped by a gripper bar or other transport mechanism inside the sheet material processing machine.

The positioning of the sheet material may be performed while the sheet material is moving along the corresponding travelling direction. Such a positioning process is called on-the-fly positioning. Usually, the sheet material is stopped after having been positioned. Thus, it is grabbed by the gripper bar while being at rest.

The objective of the present invention is to improve known positioning assemblies and sheet material processing machines equipped therewith. In more detail, a positioning assembly shall be created which is fast and precise in operation and, at the same time, is simple in structure and cost-effective.

The problem is solved by a positioning assembly of the type as mentioned above, wherein each of the clamping fingers is coupled to an individual clamping finger actuation unit such that each of the clamping fingers is movable into the clamping position and/or the release position independently from the remaining clamping fingers or in synchronization with at least one of the remaining clamping fingers. Such a positioning assembly is able to precisely clamp the sheet material on the support beam. Thus it can position the sheet material with high precision and reliability. Furthermore, the individual clamping finger actuation units are simple in design and lightweight since each one thereof only needs to actuate a single clamping finger. Consequently, the clamping fingers and the corresponding clamping finger actuation units are subject to relatively low levels of inertia and thus can be moved at high speed. This is especially the case when comparing an individual clamping finger actuation unit to an actuation unit coupled to more than one clamping finger, especially to all of the clamping fingers. It is obvious that a clamping finger actuation unit acting on one clamping finger only needs to provide a lower level of performance than an actuation unit acting on a plurality of clamping fingers. Moreover, also as compared to an actuation unit coupled to more than one clamping fingers, the arrangement of a plurality of clamping finger actuation units being independent from one another is less complex in structure. Since the respective clamping finger actuation units may be identical in design, the positioning assembly can be manufactured at comparatively low costs.

As far as the movements of the individual clamping fingers are concerned, the positioning assembly according to the invention provides a great variability. Thus, the positioning assembly is able to provide the clamping fingers with a movability suitable for a great variety of applications. Due to the individual clamping finger actuation units each of the clamping fingers is movable independently from the remaining clamping fingers. This applies to a movement into the clamping position and/or to a movement into the release position. However, depending on the application, each clamping finger may also be moved in synchronization with at least one, i.e. one, some or all, of the remaining clamping fingers. This also applies to a movement into the clamping position and/or to a movement into the release position. Thus, in an example, the clamping fingers may be individually, i.e. independently from each other, moved into the respective clamping positions, but moved back into the respective release positions in synchronization, i.e. together. Of course, also the opposite is possible. Thus, the clamping fingers may be moved in synchronization into the respective clamping positions and individually into the respective release positions. In further alternatives, both movements may be fully individual or in synchronization.

The positioning assembly comprises at least two clamping fingers. Preferably, it comprises four or five clamping fingers. Depending on the specific application, it is also possible to provide more than five clamping fingers. In doing so the sheet material can be reliably held on the support beam.

Each clamping finger actuation unit may comprise a linear guiding means by which the corresponding clamping finger is movable in a direction substantially perpendicular to the support beam. Alternatively or additionally each clamping finger actuation unit may comprise a pivoting mechanism by which the corresponding clamping finger is pivotable into the direction of the support beam. Both the linear guide means and the pivoting mechanism guarantee precise and reliable movement of the respective clamping finger.

It is possible that each clamping finger actuation unit comprises a biasing means preloading the corresponding clamping finger into the clamping position. In this context, the clamping position is to be understood as the position of the clamping finger in which it presses the sheet material onto the support beam if a sheet material is present. Otherwise, the clamping finger abuts against the support beam. The biasing means ensures a precise and reproducible clamping force. Furthermore, it allows for the sheet material to be clamped without excessive time-delay.

Preferably, the biasing means comprises a spring element. Such a biasing means is simple in structure and provides a reliable, constant biasing action. Furthermore, spring elements are only subject to minor wear and thus have a very long service life.

Advantageously, each clamping finger actuation unit comprises a lifting actuator configured for withdrawing the corresponding clamping finger from the support beam. The lifting actuator is especially configured for withdrawing the clamping finger against an action of the biasing means. In other words, the lifting actuator operates against the biasing means for operating the clamping finger. When the clamping finger is withdrawn from the support beam, a gap is created into which a sheet material can be moved or from which a sheet material can be removed.

The lifting actuator may comprise a pneumatic actuator, a linear electric actuator or a rotatory electric actuator. All of these alternatives allow for reliably and efficiently withdrawing the corresponding clamping finger.

The lifting actuator is for example designed as a so-called electric cylinder. Alternatively it may be designed as an articulated rod mechanism. In a further alternative the lifting actuator may comprise a cam mechanism.

It is noted that due to the fact that the lifting actuator is only used for withdrawing or opening the corresponding clamping finger, actuators of reduced precision and higher wear are acceptable as compared to actuators also used for closing the clamping finger and providing a reproducible clamping force in a reliable manner.

Thus, the present solution of using a biasing means for closing the clamping finger and the lifting actuator for opening it is precise and cost-effective at the same time.

In the case that the lifting actuator comprises a pneumatic actuator, each lifting actuator may be coupled with an individual pressure source. Alternatively, all lifting actuators may share a common pressure source.

The positioning assembly may comprise a common holding bar, wherein all clamping fingers are mounted on the common holding bar. Such a configuration is simple in structure. Furthermore, the clamping fingers can be mounted on the common holding bar with low effort. Preferably, the common holding bar is supported on the support beam.

According to an embodiment, the clamping fingers protrude from the holding bar in a direction towards the support beam. Thus, the clamping fingers are perfectly positioned for pressing the sheet material onto the support beam. In doing so, the clamping fingers only need to cover low traveling distances and therefore are able to clamp the sheet material at high speed and using a comparatively low amount of energy. As a further consequence of this configuration there is provided enough space for positioning sensors being adapted for detecting a positioning mark on the sheet material which may be used for deriving a position information.

In a variant, the holding bar is spaced from the support beam by at least 2 cm, preferably by at least 5 cm. The space created by this distance is sufficiently large for positioning sensors being adapted for detecting a positioning mark on the sheet material which may be used for deriving a position information. In a more general perspective, such a positioning assembly is compact.

The positioning assembly may also comprise a position sensor configured for capturing a position of the sheet material by detecting a position mark on the sheet material. The position sensor may be mounted on a sensor rail and/or within a sensor space. The rail and/or the sensor space substantially extend over the entire extension of the positioning assembly along the transverse direction. Consequently, the position sensor may be freely positioned along the sensor rail and/or within the sensor space. Thus, the positioning unit may be flexibly used in a great variety of applications requiring specific but different positions of the positioning sensor.

The position mark is for example printed on the sheet material.

In an alternative, the sensor rail comprises a mounting interface offering a plurality of discrete sensor mounting positions or is configured for mounting the sensor on an arbitrary position thereof. Thus, the sensors may be freely and reliably positioned along a direction corresponding to the general extension of the sensor rail. Preferably, this direction is transverse to the travelling direction. Also in this configuration the positioning unit may be flexibly used in a great variety of applications.

In a variant, a further positioning sensor is mounted on the sensor rail and/or within the sensor space. Thus, a total of two positioning sensors are provided. The precision by which the sheet material can be positioned is thus further enhanced.

As has been mentioned before, the relatively large space between the holding bar and the support beam allows for the transversal positioning of the sensors. Thus, two sensors suffice to handle any type of sheet since they can be arbitrarily positioned across the sheet as required by the specific application. It is especially not necessary to provide alternative sensors for different kinds of applications.

Preferably, the support beam is coupled to the drive unit via three coupling points. This especially allows to move the support beam along the x direction, along the y direction and to rotate it around the z direction.

In this context, a first coupling point may be substantially arranged in the middle of the support beam along a transverse direction, wherein a first drive means is provided at the first coupling point being adapted for moving the support beam in a transverse direction. Alternatively or additionally, a second coupling point may be arranged at a first end of the support beam along a transverse direction, wherein a second drive means is provided at the second coupling point being adapted for moving the support beam in the travelling direction. Alternatively or additionally, a third coupling point may be arranged at a second end of the support beam along a transverse direction, wherein the second end is opposed to the first end and wherein a third drive means is provided at the third coupling point being adapted for moving the support beam in the travelling direction. Thus, the support beam may be moved in the transverse direction by the first drive means. If the second drive means and the third drive means move in a synchronous manner, the support beam is moved along the travelling direction. If the second drive means and the third drive means do not move in a synchronous manner, i.e. they move into different directions or at different speed, the support beam is rotated. Preferably, all drive means are fixed in the drive unit. Moreover, at each coupling point guide mechanisms or freeing mechanisms are provided offering the degrees of freedom necessary for the above-described types of movement.

Since the positioning assembly according to the invention is lightweight, brushless motors can be used in the drive means in order to control the assembly's position and orientation.

The problem is additionally solved by a sheet material processing machine of the type as mentioned above, comprising a positioning assembly according to the invention. The effects and advantages which have been explained in connection with the positioning assembly also apply to the sheet material processing machine.

The invention will now be explained with reference to an embodiment which is shown in the attached drawings. In the drawings, FIG. 1 schematically shows a sheet material processing machine according to the invention comprising a positioning assembly according to the invention, FIG. 2 shows the positioning assembly of FIG. 1 in a more detailed view, FIG. 3 shows a drive unit of the positioning assembly of FIG. 2, wherein a support beam of the positioning assembly is only represented in a very schematical manner.

Figure 1:
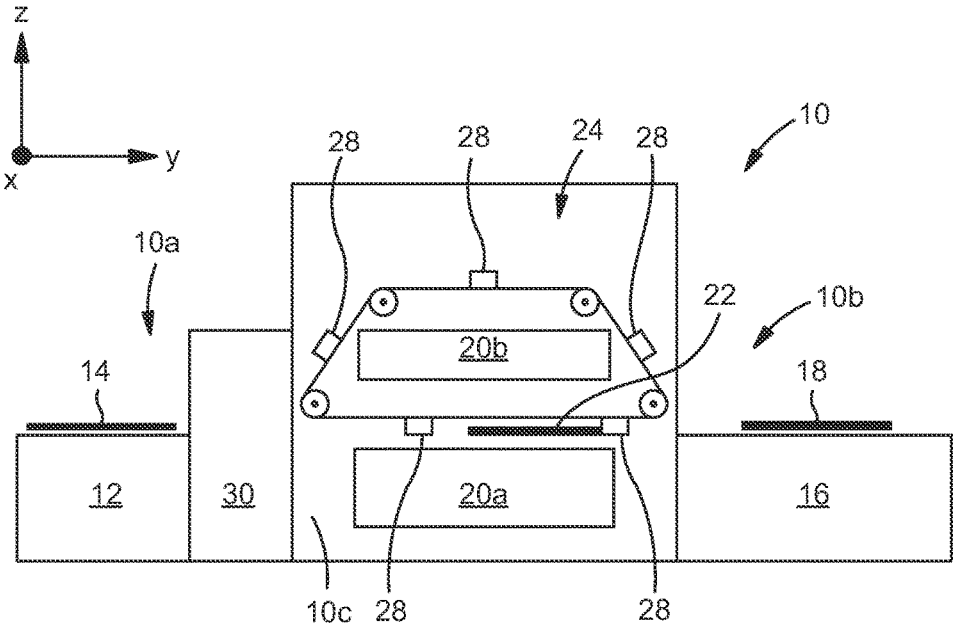
FIG. 1 shows a sheet material processing machine 10.

The sheet material processing machine 10 is coupled to a first conveyor assembly 12 which is positioned at an entry side 10*a* of the sheet material processing machine 10 and which is configured for providing sheets to be processed to the sheet material processing machine 10. An exemplary sheet or sheet material 14 to be processed is shown on the first conveyor assembly 12.

The sheet material processing machine 10 is also coupled to a second conveyor assembly 16 which is positioned at an exit side 10*b* of the sheet material processing machine 10. The second conveyor assembly 16 is configured for discharging sheets from the sheet material processing machine 10 after having been processed. An exemplary sheet or sheet material 18 which has been processed is shown on the second conveyor assembly 16.

A travelling direction of the sheet material 14, 18 thus corresponds to a y direction.

In the present example, the sheet material processing machine 10 is a sheet-to-sheet processing machine. More specifically, the sheet material processing machine is a die cutting machine.

It comprises a lower tool 20*a* and an upper tool 20*b*, wherein the upper tool 20*b* is movable with respect to the lower tool 20*a* along a z direction extending substantially vertically. Thus, in order to process a sheet, the upper tool 20*b* approaches and interacts with the lower tool 20*a*.

An exemplary sheet or sheet material 22 is arranged between the lower tool 20*a* and the upper tool 20*b*.

In order to transfer the sheet material 22 from the entry side 10*a* to the tools 20*a*, 20*b* and from there to the exit side 10*b* of the sheet material processing machine 10, a transport mechanism 24 is provided.

The transport mechanism 24 is essentially composed of a transport chain 26 to which a plurality of gripper bars 28 are mounted.

Each of the gripper bars 28 is configured for gripping an end of the sheet material 22 which is a forward end along the travelling direction y.

The transport chain 26 is actively driven such that the sheet 22 material may be moved through the sheet material processing machine 10.

At its entry side 10*a* the sheet material processing machine comprises a positioning assembly 30. In other words, the positioning assembly 30 is mounted at an entry portion 10*c* of the sheet material processing machine 10.

The positioning assembly 30 is configured for positioning a sheet or sheet material when entering the sheet material processing machine 10.

Figure 2:
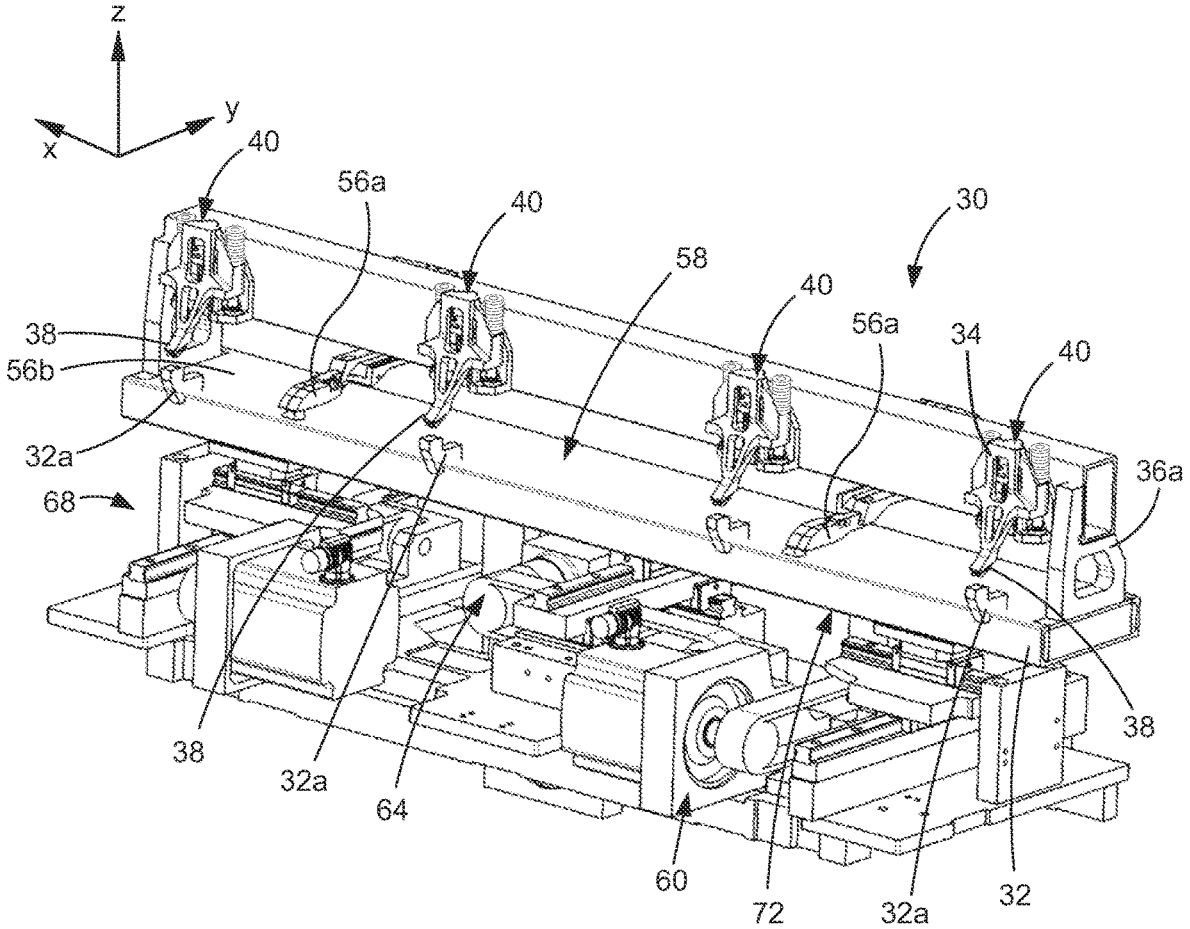

The positioning assembly 30 is shown in more detail in FIG. 2.

The positioning assembly 30 comprises a support beam 32 on which at least a portion of a sheet material to be positioned can be placed.

In the example shown in FIG. 2 the sheet material is to be placed on a plurality of support projections 32*a* forming part of the support beam 32. For better legibility only some of the support projections 32*a* are equipped with a reference sign.

On the support beam 32 a common holding bar 34 is mounted.

In more detail, the common holding bar 34 is mounted on the support beam 32 via two lateral holding bar supports 36*a*, 36*b*.

A plurality of clamping fingers 38 is mounted on the common holding bar 34.

The clamping fingers 38 protrude from the holding bar 34 in a direction towards the support beam 32, more precisely in a direction towards a respectively corresponding one of the support projections 32*a*.

In the embodiment shown in the Figures a total of five clamping fingers 38 is provided.

It is understood that the number of clamping fingers 38 can be freely chosen in the context of the specific application to be realized.

Each of the clamping fingers 38 is configured for selectively taking a clamping position in which it clamps the sheet material by pressing it onto the support beam 32, in the present example on the corresponding one of the support projections 32*a*.

Moreover, each of the clamping fingers 38 is configured for selectively taking a release position in which it releases the sheet material by being withdrawn from the support beam 32.

To this end, each of the clamping fingers 38 is coupled to an individual clamping finger actuation unit 40.

Figure 4:
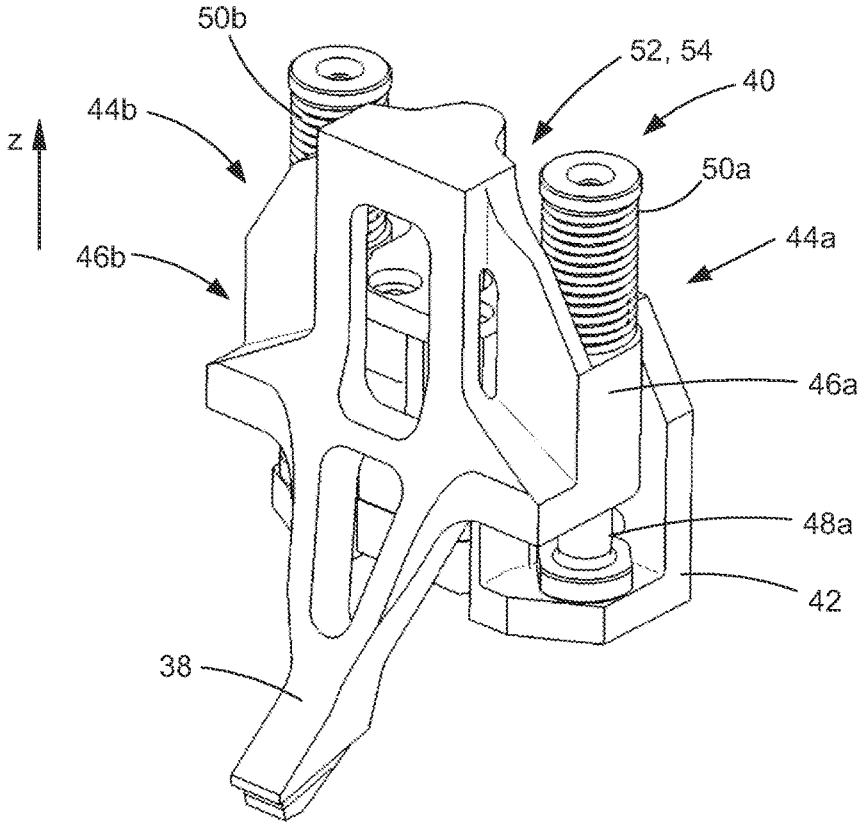
FIG. 4 shows an exemplary clamping finger and the corresponding clamping finger actuation unit of the positioning assembly of FIG. 2.
Figure 5:
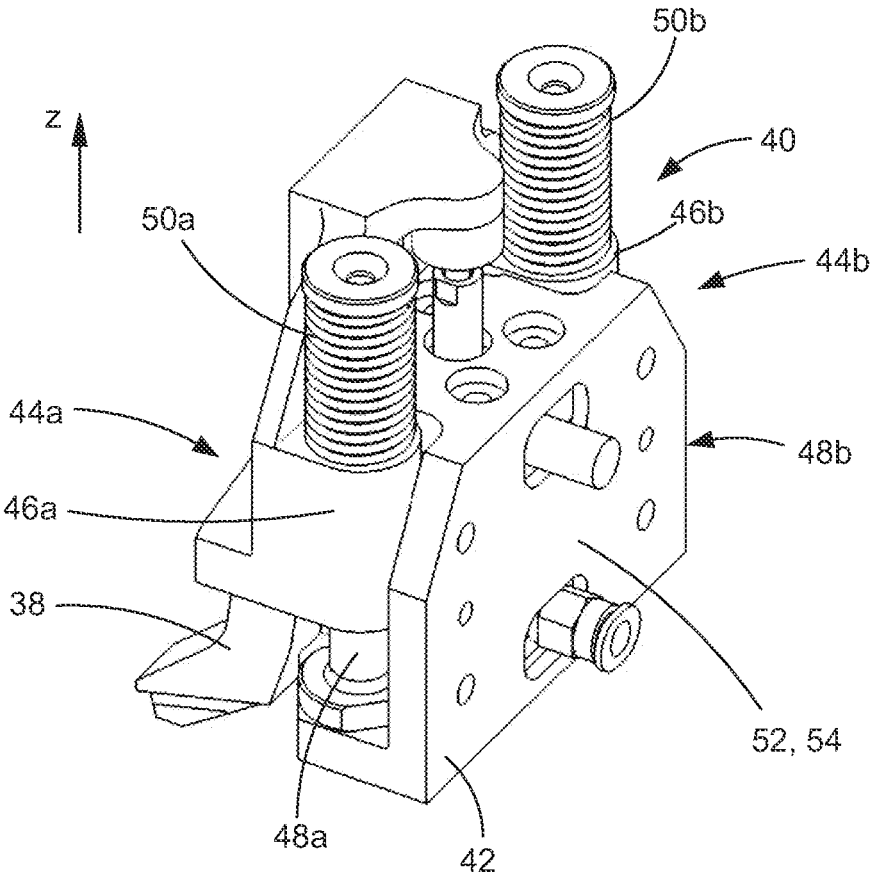
FIG. 5 shows the clamping finger and the corresponding clamping finger actuation unit of FIG. 4 from a different perspective.

An exemplary clamping finger 38 and the corresponding clamping finger actuation unit 40 is shown in FIGS. 4 and 5.

The clamping finger actuation unit 40 comprises a base part 42 on which the clamping finger 38 is movably supported via two linear guiding means 44*a*, 44*b*.

In the example shown, the linear guiding means 44*a*, 44*b* are configured such that the corresponding clamping finger 38 is movable in a direction substantially perpendicular to the support beam 32, i.e. in the z direction.

More precisely, the linear guiding means 44*a*, 44*b* each comprise a sleeve portion 46*a*, 46*b* being provided on the clamping finger 38 through which a respective guiding cylinder 48*a*, 48*b* extends. The guiding cylinders 48*a*, 48*b* are provided on the base part 42.

Each clamping finger actuation unit 40 additionally comprises biasing means 50*a*, 50*b* which are spring elements in the example shown.

The biasing means 50*a*, 50*b* preload the clamping finger 38 into the clamping position by preloading the corresponding sleeve portion 46*a*, 46*b* with respect to the corresponding guiding cylinder 48*a*, 48*b*.

Thus, in the absence of further influences, the clamping finger 38 abuts against the corresponding support projection 32*a* thereby clamping a sheet material if present.

Moreover, each clamping finger actuation unit 40 comprises a lifting actuator 52 configured for withdrawing the corresponding clamping finger 38 from the support beam 32 or the support projection 32*a*, i.e. for moving the clamping finger 38 into the release position.

This means that the lifting actuator 52 operates against the action of the biasing means 50*a*, 50*b*.

In the present example the lifting actuator 52 comprises a pneumatic actuator in the form of a pneumatic cylinder 54, wherein the cylinder housing is mounted on the base part 42 and the corresponding rod is attached to the clamping finger 38.

The pneumatic cylinder 54 is substantially arranged along the z direction. Furthermore, it is located between the guiding cylinders 48*a*, 48*b*.

It is understood that in alternative embodiments the lifting actuator 52 can alternatively comprise a linear electric actuator or a rotatory electric actuator.

Thus, each of the clamping fingers 38 can be selectively withdrawn from the support beam 32 by activating the corresponding lifting actuator 52.

When the lifting actuator 52 is deactivated, the corresponding clamping finger 38 is in its closed position.

This offers several alternatives for moving the clamping fingers 38.

Of course, each of the clamping fingers 38 can be selectively moved into the clamping position and into the release position independently from the remaining clamping fingers 38.

Alternatively, it is possible to move the clamping fingers 38 in synchronization, i.e. all clamping fingers are moved together.

Also mixtures of the above alternatives are possible. For example, the clamping fingers 38 may be selectively moved into the respective clamping positions independently from one another, but brought into the respective release positions in synchronization, i.e. together.

Also the opposite case is possible. Then the clamping fingers 38 are selectively moved into the respective clamping positions in synchronization and brought into the respective release positions independently from one another.

As has been explained before, the positioning assembly 30 is configured for positioning a sheet material.

To this end two position sensors 56*a*, 56*b* are provided (cf. FIG. 2).

Both position sensors 56*a*, 56*b* are configured for capturing a position of the sheet material by detecting a position mark, e.g. printed on the sheet material.

Thus, using the sensors 56*a*, 56*b* a translatory position of the sheet material along the x direction and along the y direction may be detected. Furthermore, a rotatory position around the z direction can be assessed.

In the example shown both sensors 56*a*, 56*b* are arranged within a sensor space 58.

The sensor space 58 substantially extending over the entire extension of the positioning assembly 30 along the transverse direction, i.e. the x direction.

The sensor space 58 is created in that the holding bar 34 is spaced from the support beam 32 and the support projections 32*a* by at least 2 cm. in the example shown the holding bar 34 is spaced from the support beam 32 by approximately 10 cm.

Consequently, the sensor space 58 is sufficiently big and the sensors 56*a*, 56*b* can be provided at any desired location within the sensor space 58. Consequently, any kind of requirements relating to the position of the sensors 56*a*, 56*b* within the positioning assembly 30 can be met. The positioning assembly 30 can thus be flexibly used for a great variety of applications.

In the example shown the sensors 56*a*, 56*b* are mounted on the holding bar 34 which serves as a sensor rail.

However, it is also possible to provide a separate sensor rail.

The sensor rail may comprise a mounting interface offering a plurality of discrete sensor mounting positions or may be configured for mounting the sensor on an arbitrary position thereof.

The support beam 32 and thus also a sheet material pressed thereon by the clamping fingers 38 is movable along the x direction, the y direction and may be rotated around the z direction.

Figure 3:
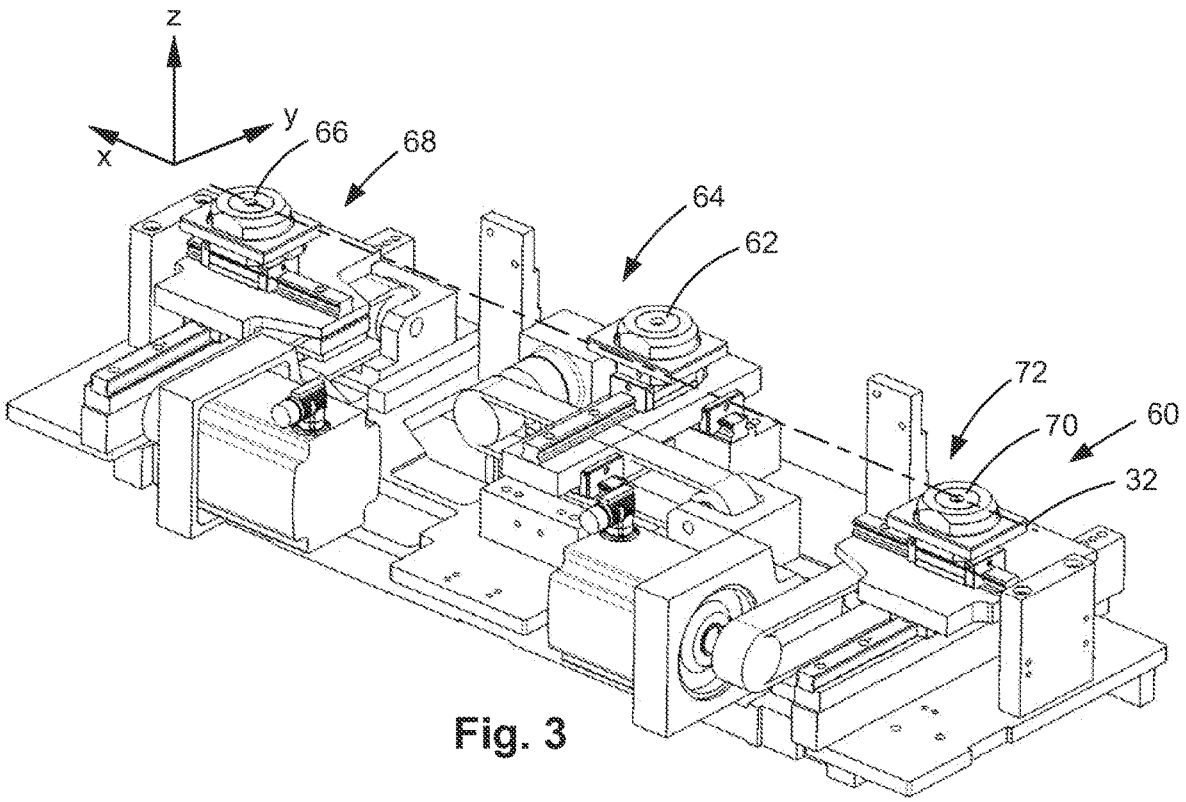

To this end the support beam 32 is coupled to a drive unit 60 (cf. FIGS. 2 and 3) via three coupling points.

The drive unit 60 comprises a first coupling point 62 being substantially arranged in the middle of the support beam 32 along a transverse direction, i.e. the x direction.

A first drive means 64 is provided at the first coupling point 62 being adapted for moving the support beam 32 in the transverse direction.

Moreover, a second coupling point 66 is arranged at a first end of the support beam 32 along the transverse direction.

A second drive means 68 is provided at the second coupling point 66 being adapted for moving the support beam 32 in the travelling direction, i.e. the y direction.

Furthermore, a third coupling point 70 is arranged at a second end of the support beam 32 along the transverse direction. The second end is opposed to the first end.

A third drive means 72 is provided at the third coupling point 70 being adapted for moving the support beam 32 in the travelling direction, i.e. the y direction.

Thus, a sheet material being engaged by the clamping fingers 38 of the positioning assembly 30 can be translationally moved along the travelling direction, i.e. the y direction by simultaneously and synchronously operating the second drive means 68 and the third drive means 72.

The sheet material can be translationally moved along a direction transverse to the travelling direction, i.e. along the x direction, by operating the first drive means 64.

The sheet material can also be rotated around the z direction by non-synchronously operating the second drive means 68 and the third drive means 72, i.e. operating the second drive means 68 and the third drive means 72 in different directions or at different speeds.

For performing these positioning activities the positioning assembly 30 is able to grab the sheet material on the fly, i.e. the sheet material is pushed onto the support beam 32 by the clamping fingers 38 while moving essentially along the travelling direction. Also the position correction can be done in superposition to a movement of the sheet material along the travelling direction.

it is preferred that the sheet material stops travelling right before it is gripped by a gripper bar 28.

It is understood that in an alternative embodiment, instead of or in addition to the linear guiding means 44*a*, 44*b* the clamping finger actuation units 40 could also comprise a pivoting mechanism by which the corresponding clamping finger 38 is pivotable into the direction of the support beam 32.

The invention claimed is:

1. A positioning assembly for positioning a sheet material, especially at an entry portion of a sheet material processing machine, the positioning assembly comprising:

a support beam on which at least a portion of the sheet material to be positioned can be placed; and a plurality of clamping fingers, wherein each of the clamping fingers is configured for selectively taking a clamping position in which the respective clamping finger clamps the sheet material by pressing the sheet material onto the support beam and a release position in which the respective clamping finger releases the sheet material by being withdrawn from the support beam, wherein the support beam is coupled to a drive unit configured for translationally moving the support beam along a travelling direction of the sheet material, translationally moving the support beam along a transverse direction transverse to the travelling direction, and rotationally moving the support beam with respect to a pivot axis being perpendicular to the traveling direction and the transverse direction, and wherein each of the clamping fingers is coupled to an individual clamping finger actuation unit such that each of the clamping fingers is movable into the clamping position and/or the release position independently from the remaining clamping fingers or in synchronization with at least one of the remaining clamping fingers.

2. The positioning assembly according to claim 1, wherein each clamping finger actuation unit comprises a linear guiding means by which the corresponding clamping finger is movable in a direction substantially perpendicular to the support beam.

3. The positioning assembly according to claim 1, wherein each clamping finger actuation unit comprises a biasing means preloading the corresponding clamping finger into the clamping position.

4. The positioning assembly according to claim 3, wherein the biasing means comprises a spring element.

5. The positioning assembly according to claim 3, wherein each clamping finger actuation unit comprises a lifting actuator configured for withdrawing the corresponding clamping finger from the support beam, especially wherein the lifting actuator is configured for withdrawing the clamping finger against an action of the biasing means.

6. The positioning assembly according to claim 5, wherein the lifting actuator comprises a pneumatic actuator, a linear electric actuator, or a rotatory electric actuator.

7. The positioning assembly according to claim 1, further comprising:

a common holding bar, wherein all clamping fingers are mounted on the common holding bar.

8. The positioning assembly according to claim 7, wherein the clamping fingers protrude from the holding bar in a direction towards the support beam.

9. The positioning assembly according to claim 1, further comprising:

a first position sensor configured for capturing a position of the sheet material by detecting a position mark on the sheet material, wherein the first position sensor is mounted on a sensor rail and/or within a sensor space, the rail and/or the sensor space substantially extending over an entire extension of the positioning assembly along the transverse direction.

10. The positioning assembly according to claim 9, wherein the sensor rail comprises a mounting interface offering a plurality of discrete sensor mounting positions or being configured for mounting the sensor on an arbitrary position thereof.

11. The positioning assembly according to claim 9, further comprising:

a second positioning sensor mounted on the sensor rail and/or within the sensor space.

12. The positioning assembly according to claim 1, wherein the support beam is coupled to the drive unit via three coupling points.

13. The positioning assembly according to claim 12, wherein a first coupling point is substantially arranged in a middle of the support beam along the transverse direction, wherein a first drive means is provided at the first coupling point being adapted for moving the support beam in the transverse direction, and/or a second coupling point is arranged at a first end of the support beam along the transverse direction, wherein a second drive means is provided at the second coupling point being adapted for moving the support beam in the travelling direction, and/or a third coupling point is arranged at a second end of the support beam along the transverse direction, wherein the second end is opposed to the first end and wherein a third drive means is provided at the third coupling point being adapted for moving the support beam in the travelling direction.

14. A sheet material processing machine, especially sheet-to-sheet processing machine or die cutting machine, comprising:

the positioning assembly according to claim 1, especially wherein the positioning assembly is mounted at an entry portion of the sheet material processing machine.

* * * * *